US005815180A

United States Patent [19]

Barbour et al.

[11] Patent Number: 5,815,180

[45] Date of Patent: Sep. 29, 1998

[54] THERMAL INKJET PRINTHEAD WARMING CIRCUIT

[75] Inventors: Michael J. Barbour; George H. Corrigan, both of Corvallis, Oreg.

[73] Assignee: Hewlett-Packard Company, Palo Alto, Calif.

[21] Appl. No.: 819,126

[22] Filed: Mar. 17, 1997

[51] Int. Cl.[6] ..... B41J 2/05

[52] U.S. Cl. ..... 347/59; 347/60

[58] Field of Search ..... 347/57–60, 185, 347/186, 212

[56] References Cited

U.S. PATENT DOCUMENTS

| | | | |
|---|---|---|---|
| 4,490,728 | 12/1984 | Vaught et al. | 347/60 |
| 4,982,199 | 1/1991 | Dunn | 347/60 |
| 5,109,234 | 4/1992 | Otis, Jr. et al. | 347/60 |
| 5,122,812 | 6/1992 | Hess et al. | 347/59 |
| 5,414,245 | 5/1995 | Hackleman | 219/458 |
| 5,428,376 | 6/1995 | Wade et al. | 347/14 |
| 5,475,405 | 12/1995 | Widder et al. | 347/14 |

OTHER PUBLICATIONS

Theordor F. Bogart, Jr. "Electronic Devices and Circuits", Merrill Publishing Company 1986, pp. 85, 134, 153.

*Primary Examiner*—Benjamin R. Fuller
*Assistant Examiner*—Juanita Stephens

[57] ABSTRACT

For each printhead nozzle, nozzle circuitry includes a warming transistor, drive transistor and heating resistor. To maintain a threshold temperature at the printhead, a warming pulse is sent from the warming transistor to the heating resistor of one or more nozzles when the temperature falls below a prescribed temperature. To fire a nozzle a firing pulse is output from the drive transistor to the heating resistor. The warming transistor is laid out as a segmented portion of the drive transistor layout area. No layout penalty is incurred by including the warming transistor for each nozzle. The source of a warming transistor is coupled in common to the source of a drive transistor. The drain of the warming transistor is coupled in common to the drain of the drive transistor. The gates are separate. The gates receive respective warming or firing control signals. The drains are coupled to the heating resistor.

5 Claims, 5 Drawing Sheets

THERMAL INKJET PRINTHEAD WARMING CIRCUIT

BACKGROUND OF THE INVENTION

This invention relates generally to thermal inkjet pen drive circuitry, and more particularly, to a circuit for actively warming the inkjet pen printhead to maintain a desired temperature during printing.

A conventional thermal inkjet pen includes multiple inkjet nozzles formed on a common die. Associated with each nozzle is a heating resistor and a drive transistor. The nozzle includes a nozzle chamber within which the heating resistor is located. To fire ink from the nozzle chamber the drive transistor outputs a firing pulse to the heating resistor. The firing pulse is a current pulse of sufficient magnitude to heat up the resistor enough to heat the ink to a firing temperature. The ink ejects from the chamber toward a print media sheet. The signals from respective drive transistors cause corresponding nozzles to fire. A controller circuit determines when any given nozzle is to fire. To minimize the time for the ink to heat up sufficiently to eject from the nozzle, it is known to preheat the heating resistors. The ejection temperature then is achieved a shorter time after the drive signal originates at the drive transistor.

According to a known preheating method, the temperature of the printhead is monitored during a print job. Whenever the detected temperature falls below a threshold temperature level, the controller signals the drive transistors to output a warming pulse to corresponding heating resistors. Such pulse is a current pulse having a lower magnitude than the current for a firing pulse. Specifically, the current magnitude is insufficient to raise the ink temperature enough for the ink to eject from the nozzle. One shortcoming of such approach is that the drive transistors can not perform warming operations during active printing of printhead nozzles. This becomes a shortcoming in for example a case of low density printing. When printing at a lower print density, the printhead may not stay at the desired warming temperature. Firing pulse bandwidth limitations, however, prevent sending warming pulses to the heating resistors.

Another known preheating method is to include passive resistor elements on the printhead apart from the nozzles. Signals to the passive resistors maintain the printhead at a desired threshold temperature. Such an approach, however, adds area and interconnect requirements to the printhead. Specifically more area is needed to include the passive resistor elements at frequent locations, and to provide interconnects to feed a signal to the resistor elements from the controller. In addition, the use of passive resistor elements is limited by current density limits for the printhead die. Accordingly there is need for an alternative preheating method.

SUMMARY OF THE INVENTION

According to the invention, for each nozzle a printhead circuit includes a warming transistor with the drive transistor and heating resistor. The drive transistor outputs a firing pulse to the heating resistor. The firing pulse is of a current magnitude sufficient to heat the resistor and ink enough to eject the ink from a nozzle. The warming transistor generates a warming pulse to the heating resistor. The warming pulse is of a current magnitude less than that of the firing pulse. The purpose of sending warming pulses to respective heating resistors is to maintain the printhead at a desired temperature during a print cycle.

According to one aspect of the invention, for each nozzle the source junction of the warming transistor is coupled in common to the source junction of the drive transistor. In addition, the drain junction of the warming transistor is coupled to the drain junction of the drive transistor. In one embodiment the commonly coupled source junctions are tied to ground, while the commonly coupled drain junctions are connected to the heating resistor.

According to another aspect of the invention, in the die layout for nozzle circuitry, the warming transistor is laid out to share a common wiring line interconnect with the drive transistor for the source contact, and a common wiring line interconnect with the drive transistor for the drain contact. The warming transistor is laid out as a segmented portion of the drive transistor having a separate gate contact. An advantage of such layout is that additional area is not required on the die to include a separate warming transistor. Additional interconnect lengths are not needed. An additional contact is included for the warming transistor gate. Accordingly, the only "penalty" is adding another contact (e.g., warming transistor gate contact). In an embodiment in which the warming transistor is activated and joins with the drive transistor in sending current to the heating resistor during firing, the same amount of power is achievable as for a prior layout of a drive transistor alone without a warming transistor being present. The same amount of substrate area is used for the warming and drive transistor as for the prior one drive transistor.

DESCRIPTION OF SPECIFIC EMBODIMENTS

Overview-Inkjet Nozzle

Figure 1:
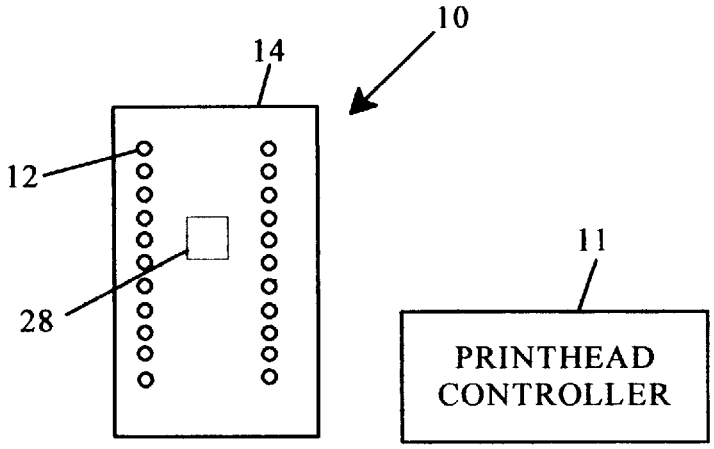
FIG. 1 is a planar view of an inkjet printhead.

FIG. 1 shows a thermal inkjet printhead 10 and a printhead controller 11.

Figure 2:
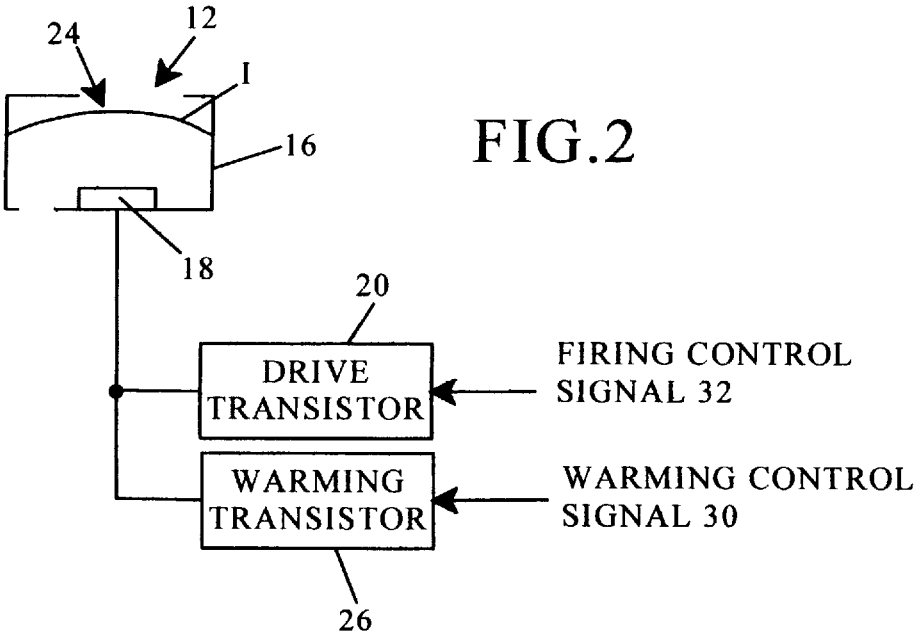
FIG. 2 is a schematic of an inkjet nozzle of FIG. 1.

The printhead 10 includes a plurality of nozzles 12, and is part of an inkjet pen (not shown) used for printing ink onto a media sheet. Ink is fed from a reservoir into the nozzles 12 of the printhead 10. As shown in FIG. 2, each nozzle 12 includes a nozzle chamber 16 for holding ink I and a heating resistor 18. The heating resistor 18 receives a firing pulse from a drive transistor 20 causing the resistor 18 to heat up the ink I in the chamber 16. The firing pulse has sufficient current to heat the resistor 18 enough, and in turn the ink, for the ink I to be ejected through an orifice 24. For each nozzle there is a corresponding nozzle chamber 16, heating resistor 18 and drive transistor 20.

According to an embodiment of the invention, for each nozzle 12 there also is a corresponding warming transistor 26. The warming transistor 26 outputs a warming pulse to the heating resistor 18. The warming pulse does not have sufficient current for the ink I to be ejected from the chamber 16. The warming transistor 26 has a maximum current magnitude rating which is less than a maximum current magnitude rating for the drive transistor 20.

The printhead 10 is formed on a die 14. Each nozzle 12 and the related nozzle circuitry (i.e., heating resistor 18, drive transistor 20 and warming transistor 26) are formed on the die. In addition a temperature sensing device 28 is formed on the die 14. The printhead controller 11 is formed integral to the printhead 10 or is electrically coupled to the printhead 10. The controller 11 monitors the temperature sensing device 28. When the detected temperature falls below a threshold temperature, the controller 11 generates a warming control signal 30 for one or more nozzles 12. In one embodiment the printhead is maintained at a temperature between 40° C. and 60° C. The warming control signal is received at the warming transistor 26 for each of such one or more nozzles 12. The controller 11 also controls firing of the nozzles during inkjet printing operations. For a given nozzle 12 to be fired the controller 11 sends a firing control signal 32 to the drive transistor 20 for such nozzle 12.

Nozzle Circuitry Schematic

Figure 3:
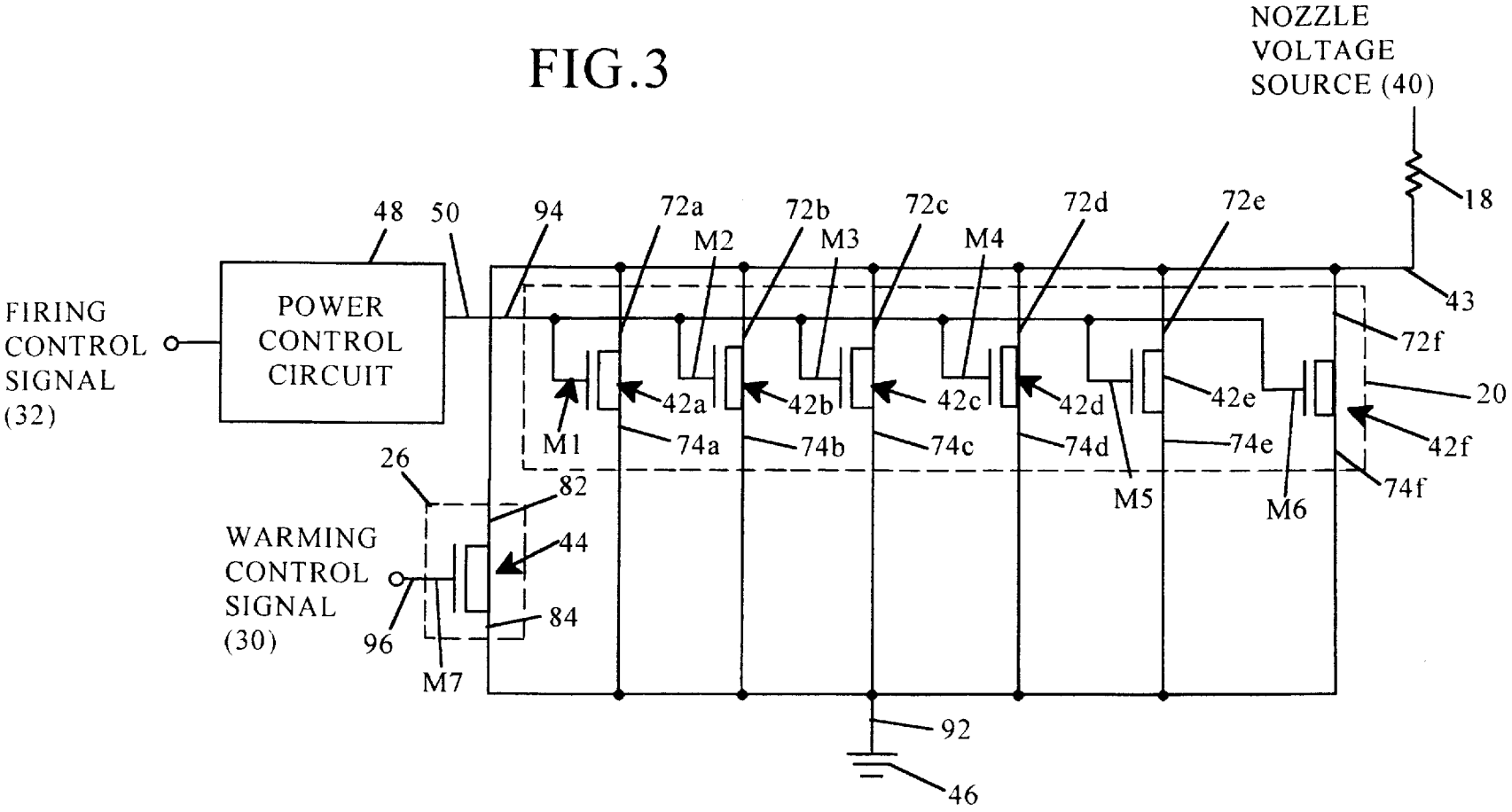
FIG. 3 is a schematic of a printhead circuit for a given nozzle according to an embodiment of the invention.

FIG. 3 is a schematic diagram of the nozzle circuitry associated with a given nozzle 12, according to one embodiment of this invention. The heating resistor 18 is coupled to a nozzle voltage source 40 at one contact and to the drains of the drive transistor 20 and warming transistor 26 at another contact. The drive transistor 20 is formed by one or more power field effect transistor (FET) devices 42. In the embodiment illustrated six FETs 42*a*–42*f* form the drive transistor 20. The warming transistor 26 is formed by a smaller field effect transistor device 44. The drains of the devices 42, 44 are coupled in common to the heating resistor 18 via an interconnect 43. The sources of the devices 42, 44 are coupled in common to ground 46. The gates M1–M6 of the drive transistor devices 42*a*–42*f* are coupled to the output of a power control circuit 48 which receives the firing control signal 32. The gate M7 of the warming transistor device 44 is coupled to the controller 11 for receiving the warming control signal 30.

Figure 4:
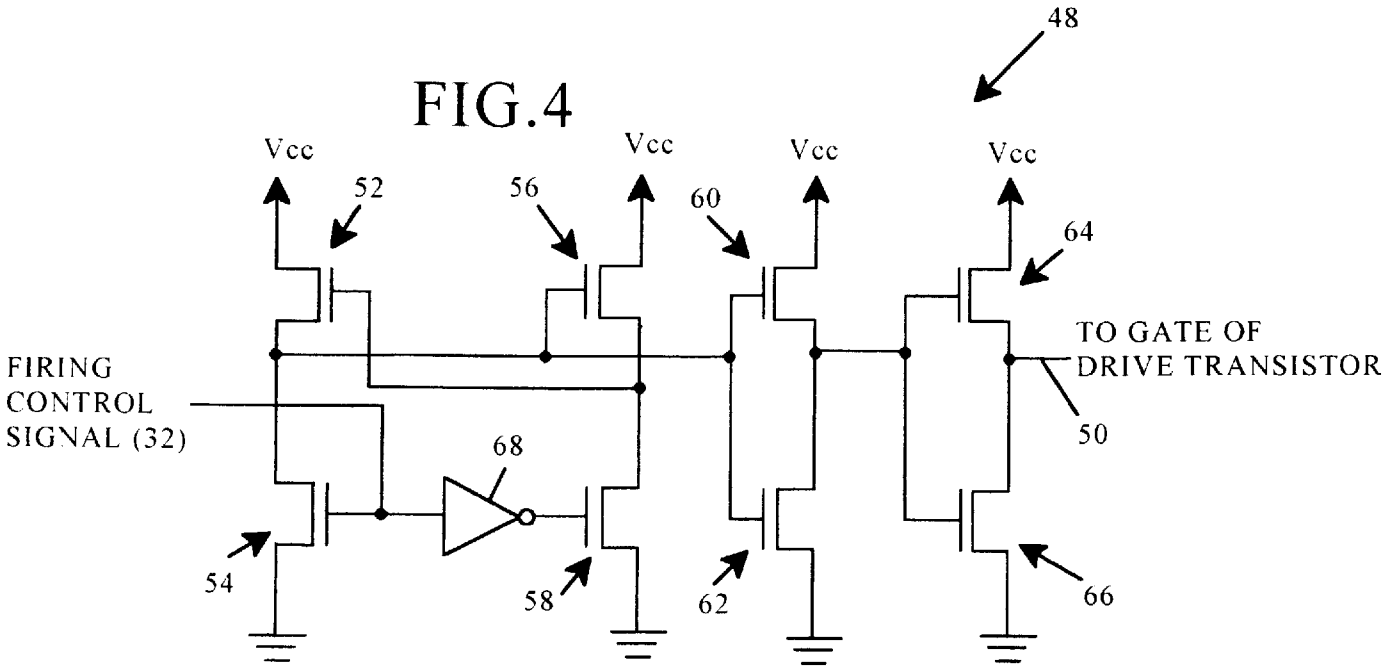
FIG. 4 is a schematic of the power control circuit of FIG. 3.

FIG. 4 is a schematic diagram of the power control circuit 48. The power control circuit 48 is formed by a set of current booster circuits. A firing control signal is received from the printhead controller 11. The signal is boosted to generate a signal 50 input to the gates M1–M6 of the drive transistor devices 42. In the embodiment illustrated the power control circuit includes eight FET device 52–66 and an invertor 68.

For the embodiment illustrated the firing control signal 32 is active when a logic low is received at the power control circuit 48. The logic low is inverted at invertor 68 resulting in a logic high signal 50 output from the power control circuit 48 into the gates M1–M6 of the drive transistor devices 42. Referring again to FIG. 3, the gates M1–M6 allow current flow through the devices 42. Specifically, current flows from the nozzle voltage source 40 through the heating resistor 18 into the drains 72*a*–72*f* and out the source 74*a*–74*f* to ground 46. When an inactive signal (e.g., a logic high) is received at the power control circuit 48, signal 50 is a logic low. Thus, the junction from drain to source at drive transistor devices 42*a*–42*f* is closed.

When an active signal level is received at the warming transistor device 44, gate M7 enables current flow through the device 44. Specifically, current flows from the nozzle voltage source 40 through the heating resistor 18 into the drain 82 and out the source 84 of the warming transistor device 44 to ground 46. When an inactive signal level is received at the gate M7 of the warming transistor device 44, the junction from drain 82 to source 84 is closed.

The warming control signal 30 and the firing control signal 32 are separate signals having separate signal paths. To generate a warming pulse, the firing control signal 32 is inactive and the warming control signal is active. Thus, a small current flows from the nozzle voltage source 40 through the heating resistor 18 into the drain 82 and out the source 84 of the warming transistor device 44 to ground 46. The current flowing through the heating resistor 18 is based upon the size of the device 44. Such current is insufficient to cause the nozzle 12 to fire. Warming transistor device 44 is used a switching device turning current flow through the device 44 on or off. In one embodiment the current magnitude for a warming pulse is between 2.0 and 3.5 mA, and the nozzle voltage is 21 volts.

To generate a firing pulse, in one embodiment the warming control signal is inactive and the firing control signal is active. Thus, current flows from the nozzle voltage source 40 through the heating resistor 18 into the drains 72*a*–72*f* and out the source 74*a*–74*f* to ground 46. The current flowing through the heating resistor 18 is based upon the number and size of the transistor devices 42. Such current is enough to cause the nozzle 12 to fire. In one embodiment the current magnitude for a firing pulse is 300 mA and the nozzle voltage is 21 volts. Other voltage levels and current levels are used in alternative embodiments.

According to another embodiment, to fire the nozzle 12, both the firing control signal 32 and the warming control signal 30 are active so that current flows from the nozzle voltage source 40 through the heating resistor 18 and through all the devices 42, 44 to ground 46.

When both the firing control signal 32 and the warming control signal 30 are inactive current does not flow through the devices 42, 44. Thus, current does not flow through the heating resistor 18.

Warming/Drive Transistor Layout

Figure 5:
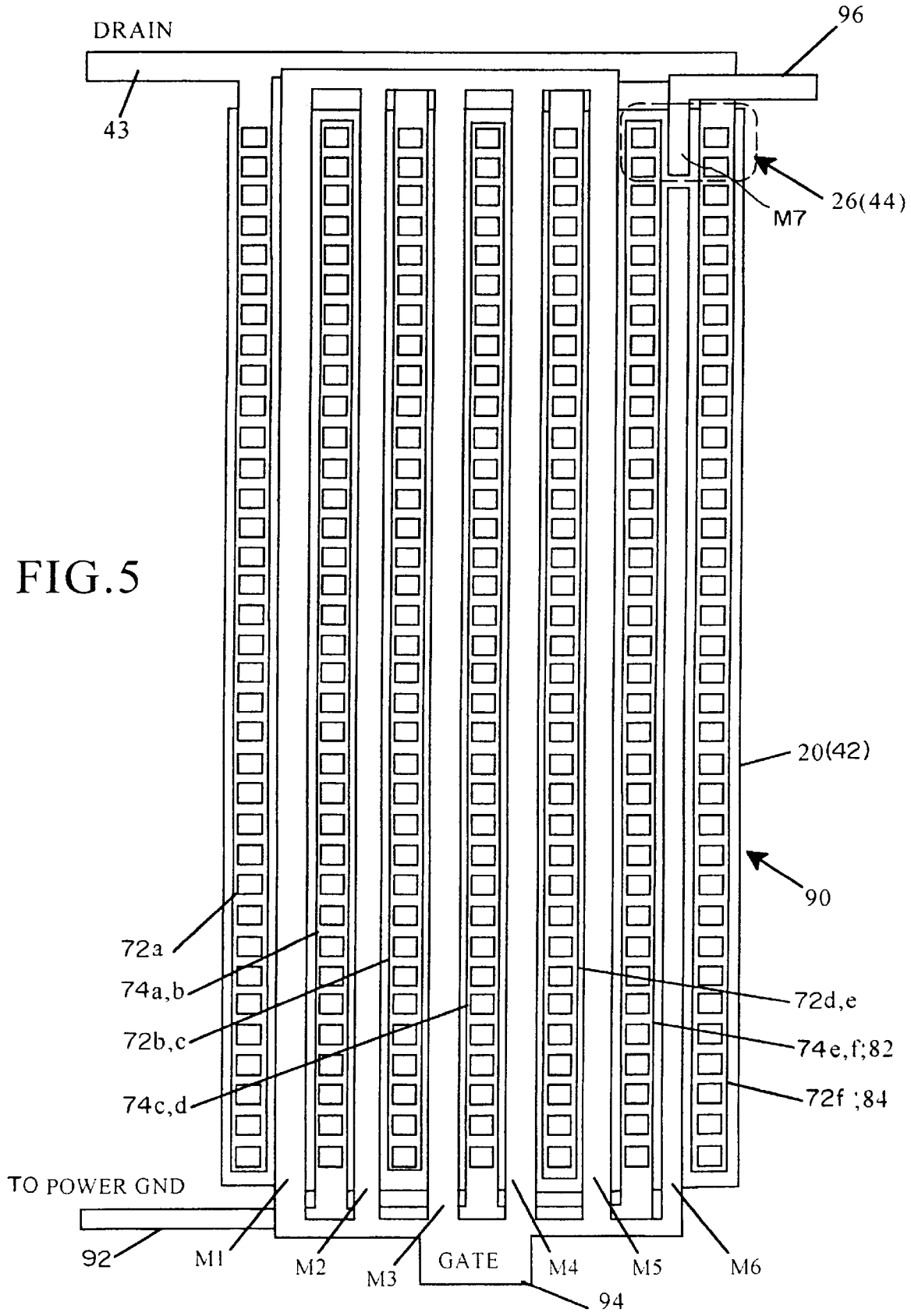
FIG. 5 is a diagram of a layout pattern for the drive transistor and warming transistor of FIG. 3 according to an embodiment of this invention.

FIG. 5 shows a die layout 90 for a drive transistor 20 and warming transistor 26 for a given nozzle 12. The drive transistor is formed by the six FET devices 42 and the warming transistor 26 is formed by the FET device 44 (see FIG. 3). The layout 90 includes a power ground interconnect 92, a drain interconnect 43, a drive transistor gate interconnect 94, and a warming transistor gate interconnect 96. The power ground interconnect 92 is coupled to the sources 74*a*–74*f* of the drive transistor FET devices 42 and the source 84 of the warming transistor FET device 44. The drain interconnect 43 is coupled to the drains 72*a*–72*f* of the drive transistor FET devices 42 and the drain 82 of the warming transistor FET device 44. The gate interconnect 94 is coupled to the gates M1–M6 of the drive transistor FET devices 42. The gate interconnect 96 is coupled to the gate M7 of the warming transistor FET device 44. In particular, note that the warming transistor 26 is formed at a small segment of the layout area used for the drive transistor 20. The only layout penalty in adding the warming transistor 26 is the addition of the gate interconnect 96.

The drive transistor 20 occupies a first area of the layout, while the warming transistor 26 occupies a second area of the layout. In the embodiment illustrated in FIG. 5, the second area is a segmented portion of the first area. In one embodiment the second area is dedicated to the warming transistor 26. In another embodiment in which the warming transistor 26 and the drive transistor both turn on to generate a firing pulse, the warming transistor 26 in effect occupies a segmented portion of the drive transistor 20 and the second area of the layout is shared by the warming transistor 26 and the drive transistor 20.

Figure 6:
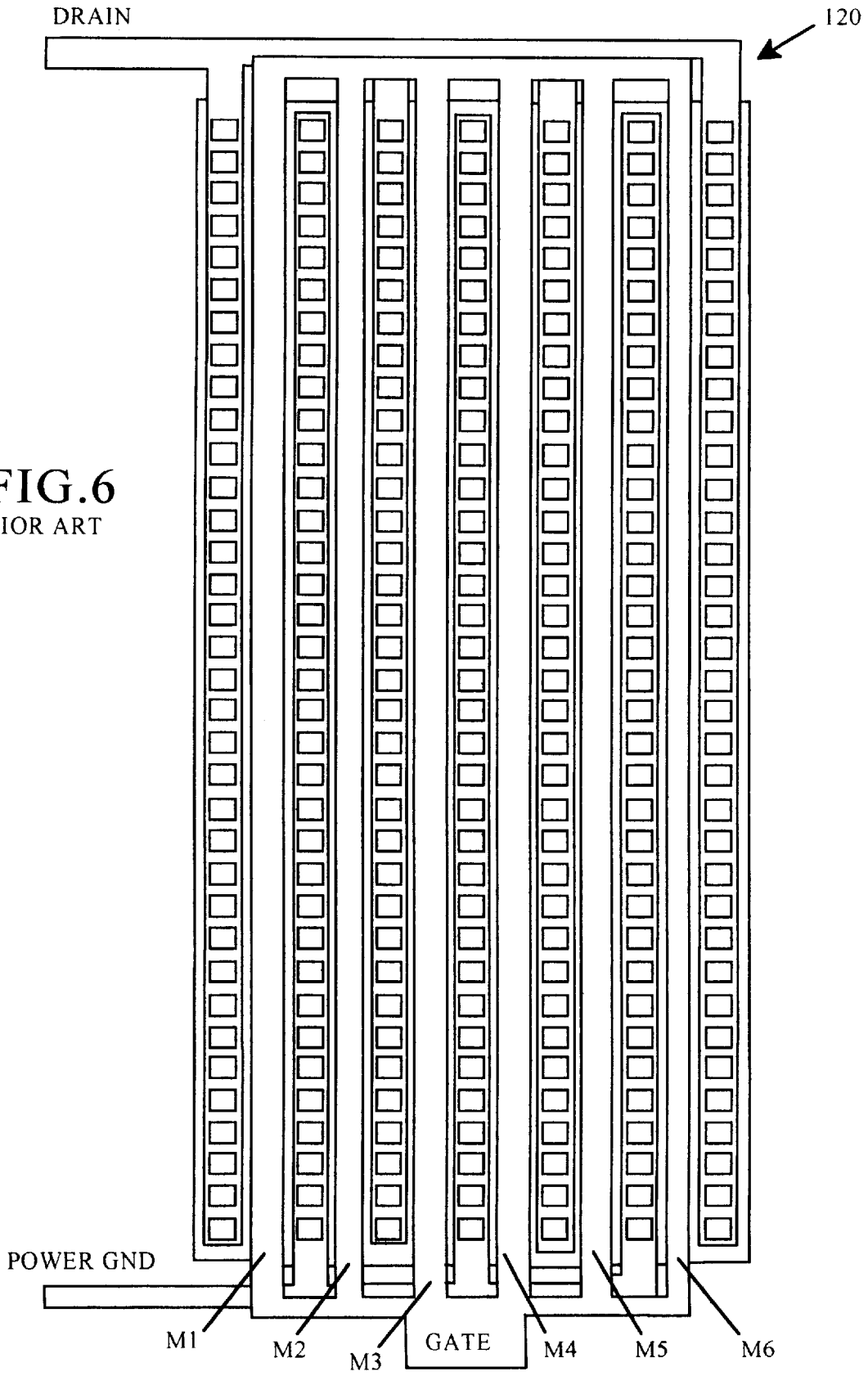
FIG.6 PRIOR ART
FIG. 6 is a diagram of a layout pattern for a conventional drive transistor.

FIG. 6 shows the layout of a conventional drive transistor 120 for a conventional printhead which does not include a warming transistor. As described in the background of the invention, the conventional drive transistor generates a firing pulse or a warming pulse. The same circuits and signal paths perform both function. The drive transistor 120, however, generates a current magnitude at one level to fire the conventional nozzle and at another level to warn the printhead in the vicinity of the nozzle. Comparing FIGS. 5 and 6, one can see that the warming transistor 26 of this invention is formed from a small piece of what in a conventional circuit would be the drive transistor. Only a small piece is used because the warming pulse is of a significantly smaller current magnitude than the firing pulse. In the inventive embodiment of FIG. 5, the same current is achieved for a firing pulse as in the conventional FIG. 6 layout by activating both the warming transistor 26 and the drive transistor 20 when firing the nozzle 12.

Meritorious and Advantageous Effects

The die layout in FIG. 5 for a given drive transistor 20 and warming transistor 26 provides maximum efficiency for silicon die area. Merely a small area on the perimeter of a large power device is used for the warming transistor device 44. Being on the perimeter, the warming transistor device 44 is easy to connect and uses existing conducting paths. In addition an added heating element is not required. The heating resistor within the nozzle chamber is used for warming. The warming transistor device 44, however, is independent of the large drive transistor 20 and can be controlled asynchronously by the printhead controller 11. In one implementation the printhead nozzles are allocated among multiple zones of the printhead area. Each zone is separately controlled. A separate temperature sensing device 28 is used for each zone.

Although a preferred embodiment of the invention has been illustrated and described, various alternatives, modifications and equivalents may be used. For example, although specific voltage levels, current levels and logic states are described, different values and logic states are implemented for alternative embodiments. Therefore, the foregoing description should not be taken as limiting the scope of the inventions which are defined by the appended claims.

What is claimed is:

1. A thermal inkjet pen printhead formed on a common die, the printhead comprising:

a plurality of inkjet nozzle chambers formed in the die;

for each one nozzle chamber, a corresponding heating resistor and a corresponding transistor being formed in the die, wherein the corresponding heating resistor is located within said one nozzle chamber, and wherein the corresponding transistor is segmented having a first portion and a second portion, the second portion being smaller than the first portion, wherein the first portion and second portion are electrically coupled to the corresponding heating resistor, and wherein the second portion is smaller than the first portion so as to have a maximum current magnitude rating which is less than a maximum current magnitude rating of the first portion, wherein the first portion comprises a plurality of first transistive devices and the second portion comprises a second transistive device;

wherein to perform a firing at said one nozzle chamber both the first portion and second portion of the transistor are activated to generate a firing pulse which heats the heating resistor to a temperature sufficient to eject ink from the corresponding nozzle chamber, and wherein to perform a warming at said one nozzle chamber the second portion and not the first portion of the transistor is activated to generate a warming pulse which warms the heating resistor to a temperature insufficient to eject ink from the corresponding chamber.

2. A thermal inkjet pen printhead having a plurality of nozzles, each of said nozzles having a chamber, wherein for each one nozzle there is a corresponding nozzle circuitry, the plurality of nozzles and said each one nozzle corresponding nozzle circuitry formed on a common die, the nozzle circuitry for said each one nozzle comprising:

said heating resistor located within a nozzle chamber of said each one nozzle;

a transistor electrically coupled to the heating resistor, the transistor being segmented to form a first portion and a second portion, the transistor having a common source for the first portion and the second portion, a common drain for the first portion and the second portion, and having a first gate for the first portion and a separate second gate for the second portion, and wherein the common drain is electrically coupled to the heating resistor, wherein the second portion is smaller than the first portion so as to have a maximum current magnitude rating which is less than a maximum current magnitude rating for the first portion;

a first signal for firing said one nozzle, the first signal being input to the first gate causing the transistor to output to the heating resistor an output signal having sufficient current to cause said one nozzle to fire; and a second signal for warming said one nozzle, the second signal being input to the second gate and not to the first gate during a warming operation causing the transistor to output to the heating resistor the output signal at insufficient current to cause said each one nozzle to fire.

3. The printhead of claim 2, wherein to fire said each one nozzle the first signal is input to the first gate and the second signal is input to the second gate causing the transistor to output to the heating resistor the output signal which causes said each one nozzle to fire.

4. A method for controlling a thermal inkjet printhead having a plurality of nozzles, in which for each one nozzle there is a corresponding nozzle chamber, a corresponding heating resistor, and a corresponding segmented transistor, wherein the plurality of nozzles, the corresponding nozzle chamber, the corresponding heating resistor and the corresponding segmented transistor are formed on a common die, the corresponding segmented transistor for said each one nozzle being electrically coupled to the corresponding heating resistor, said segmented transistor having a first portion and a second portion, a common source connection for the first portion and the second portion, a common drain connection for the first portion and second portion, and a first gate connection for the first portion and a second gate for the second portion, and wherein for said each one nozzle the common drain connection is electrically coupled to the heating resistor of said each one nozzle, and wherein for said segmented transistor the second portion is smaller than the first portion so as to have a maximum current magnitude rating which is less than a maximum current magnitude rating for the first portion, the method comprising the steps of:

firing a first nozzle of said plurality of nozzles in response to a first signal being in an active state, the first signal being received at the first gate connection of the segmented transistor of said first nozzle, the active first signal causing said segmented transistor of said first nozzle to output to the heating resistor of said first nozzle an output signal at sufficient current to cause said first nozzle to fire;

inactivating the first signal;

monitoring temperature of the printhead; and when the monitored temperature falls below a threshold temperature, and while said first signal is in inactive, warming the first nozzle in response to an active second signal, the second signal being received as the second gate connection of the segmented transistor of said first nozzle, the second signal causing the segmented transistor to output to the heating resistor the output signal at insufficient current to cause said first nozzle to fire.

5. The method of claim 4, wherein the step of firing the first nozzle occurs in response to an active first signal received at the first gate of the segmented transistor of the first nozzle and an active second signal received at the second gate of the segmented transistor of the first nozzle, the active first signal and active second signal causing the transistor to output to the heating resistor the output signal at sufficient current to cause said first nozzle to fire.

* * * * *